US005861597A

United States Patent [19]

Bolongeat-Mobleu et al.

[11] Patent Number: 5,861,597

[45] Date of Patent: Jan. 19, 1999

[54] VACUUM ELECTRICAL SWITCH

[75] Inventors: Roger Bolongeat-Mobleu; Frédéric Burnaz, both of Echirolles; Hans Schellekens, Meylan, all of France

[73] Assignee: Schneider Electric S.A., France

[21] Appl. No.: 543,389

[22] Filed: Oct. 16, 1995

[30] Foreign Application Priority Data

Oct. 31, 1994 [FR] France ..... 94 13408

[51] Int. Cl.[6] ..... H01H 33/66

[52] U.S. Cl. ..... 218/141; 218/42

[58] Field of Search ..... 218/22–30, 42, 218/118, 123–129, 141, 142

[56] References Cited

U.S. PATENT DOCUMENTS

| | | | |
|---|---|---|---|
| 3,366,762 | 1/1968 | Smith, Jr. | 200/144 |
| 3,372,258 | 3/1968 | Porter | 200/144 |
| 3,469,050 | 9/1969 | Robinson et al. | 200/144 |
| 4,415,787 | 11/1983 | Yamanaka | 200/144 B |
| 4,661,666 | 4/1987 | Sakuma et al. | 200/144 B |
| 4,707,577 | 11/1987 | Tamaki et al. | 200/144 B |
| 4,975,552 | 12/1990 | Niegl et al. | 200/144 B |
| 5,280,144 | 1/1994 | Bologeat-Mobleu et al. | 200/148 R |

FOREIGN PATENT DOCUMENTS

| | | | |
|---|---|---|---|
| 0186030 | 7/1986 | European Pat. Off. | H01H 33/66 |
| 0329410 | 8/1989 | European Pat. Off. | H01H 33/66 |
| 538157 | 4/1993 | European Pat. Off. | H01H 33/66 |
| 2341932 | 9/1977 | France | H01H 33/66 |
| 3823297 | 5/1989 | Germany | H01H 33/66 |

*Primary Examiner*—Michael A. Friedhofer
*Attorney, Agent, or Firm*—Parkhurst & Wendel, L.L.P

[57] ABSTRACT

A vacuum switch has an elongated vacuum cartridge with a cylindrical enclosure blanked off by two end-plates, in which there are housed two arcing contacts respectively stationary and movable, and a coil designed to produce an axial magnetic field in the arc formation zone. The coil has one end arranged as a current conducting strip and an end electrically connected to one of the above-mentioned arcing contacts. The two ends of the coil are superposed and electrically connected, and a branch-off means, such as for example a magnetic circuit, is fitted between these two ends to branch off a part of the main current through the coil during breaking in order to create the axial magnetic field.

15 Claims, 6 Drawing Sheets

VACUUM ELECTRICAL SWITCH

BACKGROUND OF THE INVENTION

The present invention relates to an electrical switch designed to break an electrical circuit the switch comprising an elongated vacuum cartridge with a cylindrical enclosure blanked off by two end-plates, in which there are housed two arcing contacts, one, stationary, of which is fixedly secured to one of the above-mentioned end-plates whereas the other, movable, is mounted axially slidingly inside the cartridge, and at least one coil designed to produce an axial magnetic field in the arc formation zone, said coil comprising a first end electrically connected to one of the above-mentioned arcing contacts and a second end arranged as a current conducting strip.

A known circuit breaker (document FR-2,682,808) of the kind mentioned comprises a ring-shaped coil placed in an annular housing formed by the end-plate associated to the coil in such a way that the coil is arranged coaxially outside the cartridge facing the separation gap of the arcing contacts. One of the ends of the coil is mechanically secured and electrically connected to the stationary arcing contact, whereas the other end is electrically connected to a current conducting strip while being electrically isolated from the stationary arcing contact. One of the drawbacks of this type of circuit breaker lies in the fact that as the coil is connected in series with the arcing contacts, the whole of the main current flows through the coil. This results in a coil of large cross-section having to be fitted, which therefore presents considerable overall dimensions.

SUMMARY OF THE INVENTION

The present invention solves these problems and proposes a switch notably a vacuum switch using a coil for creation of an axial magnetic field, of simple design and small dimensions.

For this purpose, the object of the present invention is to achieve a switch of the kind previously mentioned, characterized in that the above-mentioned two ends of the coil are electrically connected and that it comprises a branch-off means fitted between the above-mentioned two ends to branch a part of the main current off through the coil during breaking, in order to create the above-mentioned axial magnetic field. Advantageously, the two ends of the coil are superposed.

According to the invention the coil can be formed by one or more windings of small cross-section.

According to a first embodiment of the invention, the branch-off means comprises a resistive element.

According to a particular feature, this resistive element comprises a resistive washer electrically connecting the above-mentioned two ends of the coil.

According to another embodiment, the above-mentioned branch-off means comprises a magnetic circuit.

According to a particular feature, the magnetic circuit is placed around a conductor electrically connecting the above-mentioned two ends of the coil.

According to another feature, the magnetic circuit comprises at least one air-gap designed to delay branching off of the current until a certain intensity value of the main current has been reached.

Advantageously, branching off in the winding takes place above 8000 A.

According to another feature, the coil is formed by a winding whose two ends both extend with an angular offset, parallel to the end-plates of the cartridge.

According to another feature, the first end of the coil is mechanically secured and electrically connected to the stationary arcing contact.

Advantageously, the above-mentioned branch-off means branches off between 10 and 60% of the current into the coil.

The coil and branch-off means are placed inside or outside the vacuum cartridge.

According to a particular embodiment, the coil and branch-off means are placed inside the arcing contact between a conducting rod and an electrode of said contact.

Advantageously, each of the contacts has an associated coil and branch-off means, which are placed inside the vacuum cartridge.

BRIEF DESCRIPTION OF THE DRAWINGS

Other advantages and features of the invention will become more clearly apparent from the following detailed description which refers to the accompanying drawings given for example purposes only and in which.

DESCRIPTION OF THE PREFERRED EMBODIMENT

Figure 1:
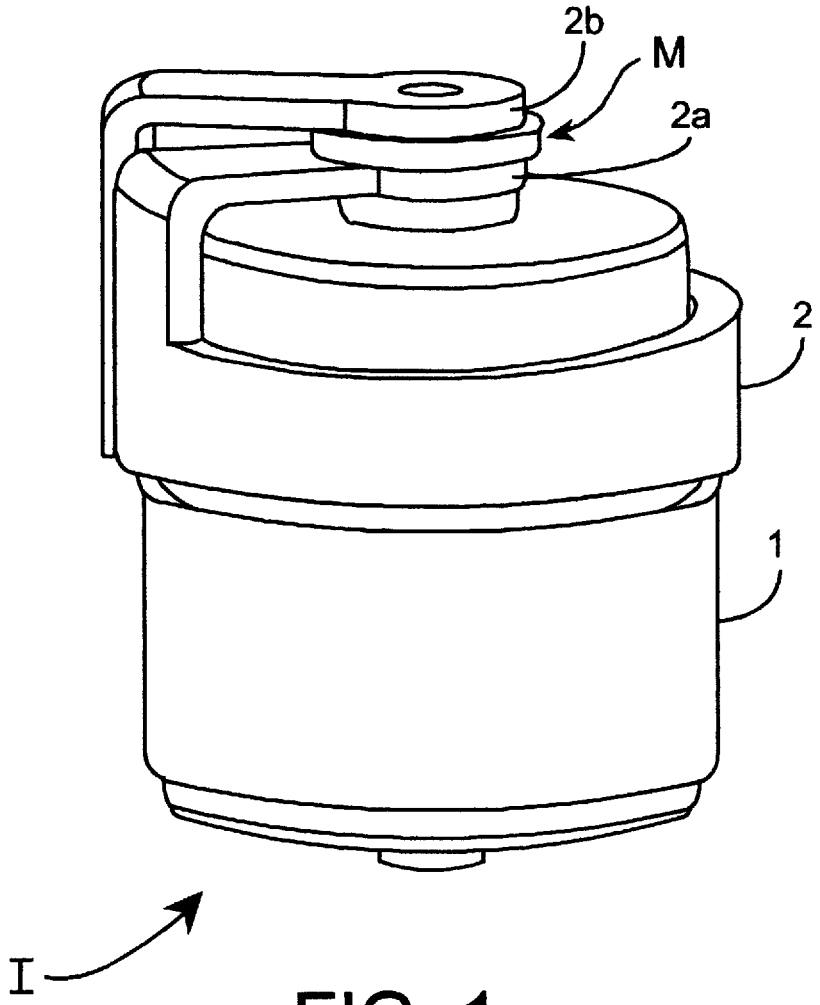
FIG. 1 is a perspective view of a switch according to the invention.
Figure 2:
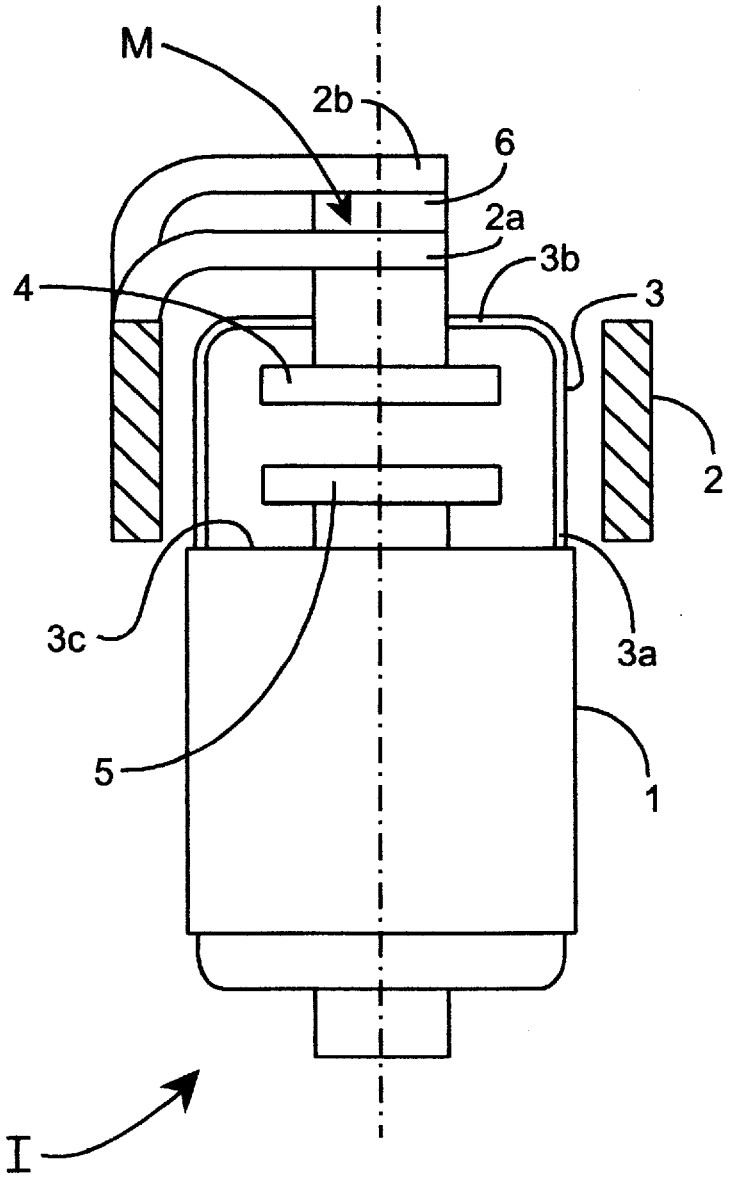
FIG. 2 is an axial sectional view of the previous figure, illustrating a first embodiment of the invention.
Figure 3A:
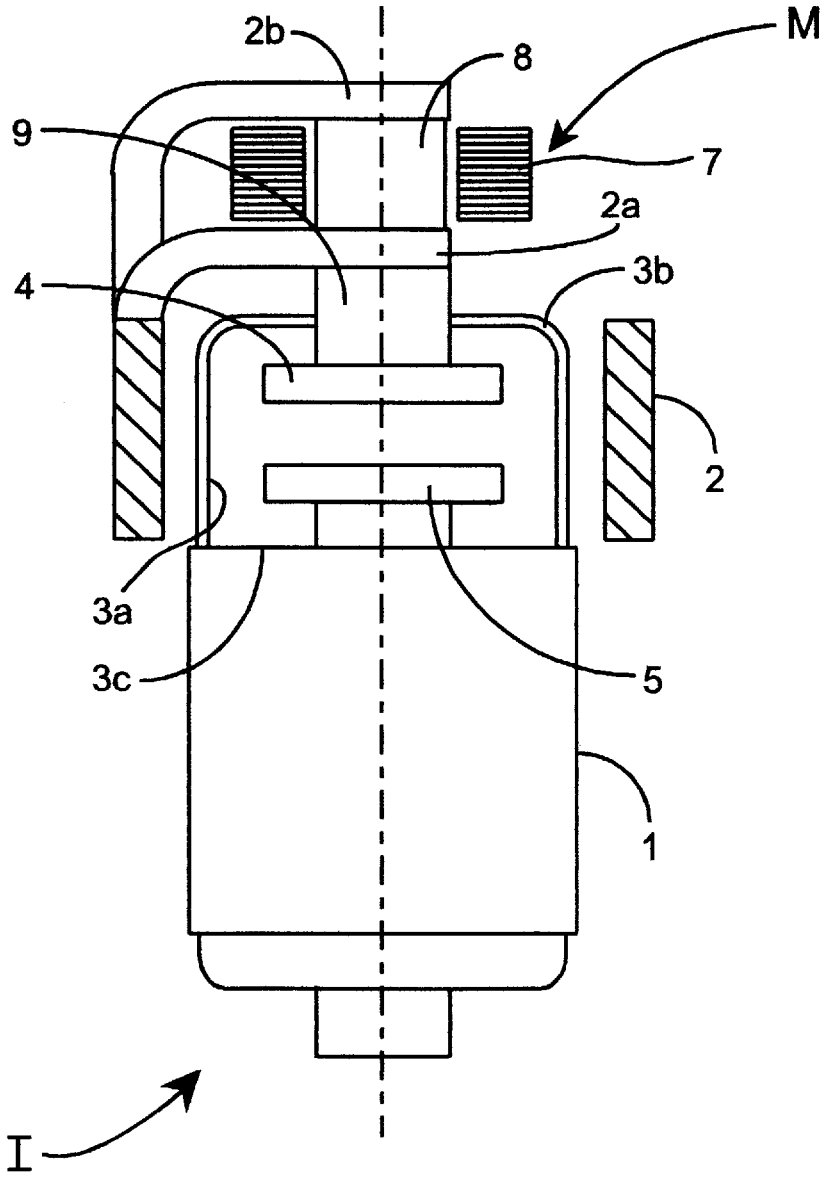
FIG. 3*a* is an axial sectional view of the FIG. 1, illustrating a second embodiment of the invention.

In FIGS. 1, 2 and 3*a*, a vacuum switch I can be seen mainly comprising a vacuum cartridge (or envelope) 1 and a coil 2 coaxially mounted around said cartridge in a manner which will be described by the following. This cartridge 1 comprises an enclosure 3 formed by a cylindrical part 3*a* closed by two opposite end-plates 3*b*, 3*c*. Inside the enclosure 3 there are arranged a stationary arcing contact 4 fixedly secured to one 3*b* of the above-mentioned end-plates, and a movable arcing contact 5 supported by an operating rod (not represented) passing tightly through the other 3*c* of the two end-plates. The arcing contacts 4, 5 are disk-shaped and made of a low resistivity material. The coil 2 is in the form of a ring arranged coaxially outside the cartridge 1 facing the gap separating the arcing contacts 4, 5. This coil 2 is formed by a winding and comprises a first and a second end 2*a*, 2*b* each extending with an angular offset, parallel to said end-plate 3*b* associated to the coil 2. The first end 2*a* is mechanically secured and electrically connected to the stationary contact 4. The second end 2*b* forms a current conducting strip connected to that of the circuit breaker and is mechanically fixed to the stationary contact 4 by any suitable means, such as a screw passing through aligned holes provided in the above-mentioned two ends 2*a*, 2*b* of the coil 2, and screwed into the stationary arcing contact 4.

According to the invention, the switch I comprises in addition a means M, fitted between the above-mentioned two ends 2*a*, 2*b* of the coil 2, to branch off a part of the current coming from the current conducting strip 2*b* through the winding 2, whereas the complementary part of the current flows through the two ends 2*a*, 2*b* and the two arcing contacts 4, 5 until the moment breaking takes place.

According to a particular embodiment of the invention illustrated in FIG. 2, this means M is a resistive element 6, in the form of a washer, fitted between the two ends 2*a*, 2*b* of the winding 2.

Figure 3B:
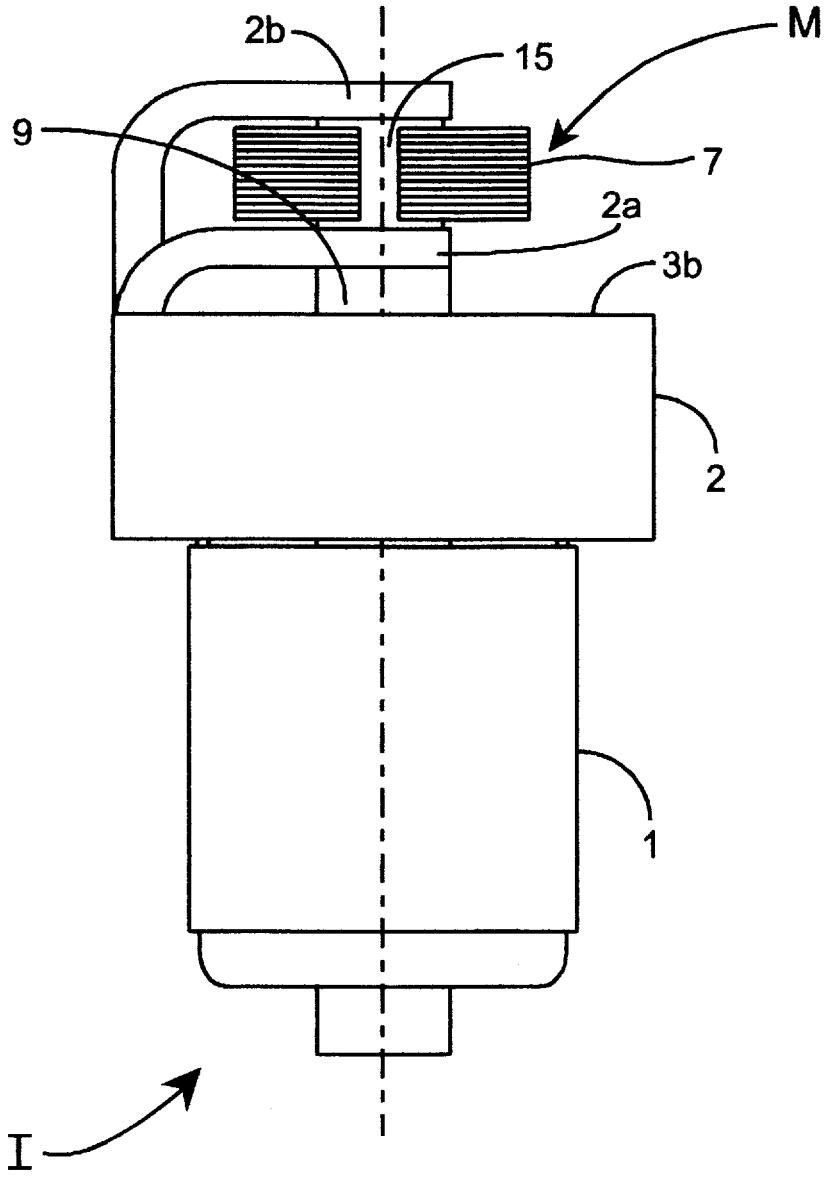
FIG. 3*b* shows the second embodiment of the invention with an air gap.

According to another particular embodiment of the invention illustrated in FIG. 3*a*, this means M is a magnetic circuit 7 disposed around a conductor 8 electrically connecting the above-mentioned two ends 2*a*, 2*b* . This magnetic circuit 7 will advantageously comprise one or more air-gaps 15 according to the performances required, as shown in FIG. 3*b*.

Advantageously for these three different embodiments, between 10 and 60% of the total current in the winding will be branched off, branching off less than 10% being insufficient to achieve breaking whereas branching off more than 60% would be liable to generate an undesirable heat rise.

The operation of the switch I of the invention will be described briefly hereafter successively in its two embodiments illustrated respectively in FIGS. 2 and 3*a*.

This vacuum switch I is particularly designed to perform vacuum breaking in an axial field for a permanent current in the 630 A to 3150 A range.

According to the embodiment illustrated in FIG. 2, branching off of the current takes place as soon as the current starts to flow, during breaking, and in linear manner. This branching off generates an axial magnetic field necessary for breaking in the separation zone of the arcing contacts.

It should be noted that element 6 will advantageously be a washer made of a high resistivity material (stainless steel or other).

According to the embodiment illustrated in FIG. 3*b*, the magnetic circuit 7 comprises an air-gap and will therefore remain practically inactive up to a certain current intensity value. Up to this value, the current branch-off through the winding 2 will be low. When this value is reached, the magnetic circuit 7 is activated, which will result in a certain quantity of current being branched off through the winding 2, this branch-off creating an axial magnetic field sufficient to achieve breaking.

It should also be noted that this circuit activation value will advantageously be 8000 A, a value above which an axial magnetic field is necessary to achieve breaking.

One of the advantages procured by the invention lies in the fact that the winding 2 can remain of small cross-section compared to the cross-section of the conductor 9 through which the permanent current flows, unlike solutions wherein the coil 2 is connected in series with the arcing contacts 4, 5 and conducts almost all of the permanent current. The cross-section of the winding 2 can therefore be reduced, all the more so as when breaking takes place the flow time is short.

Figure 4:
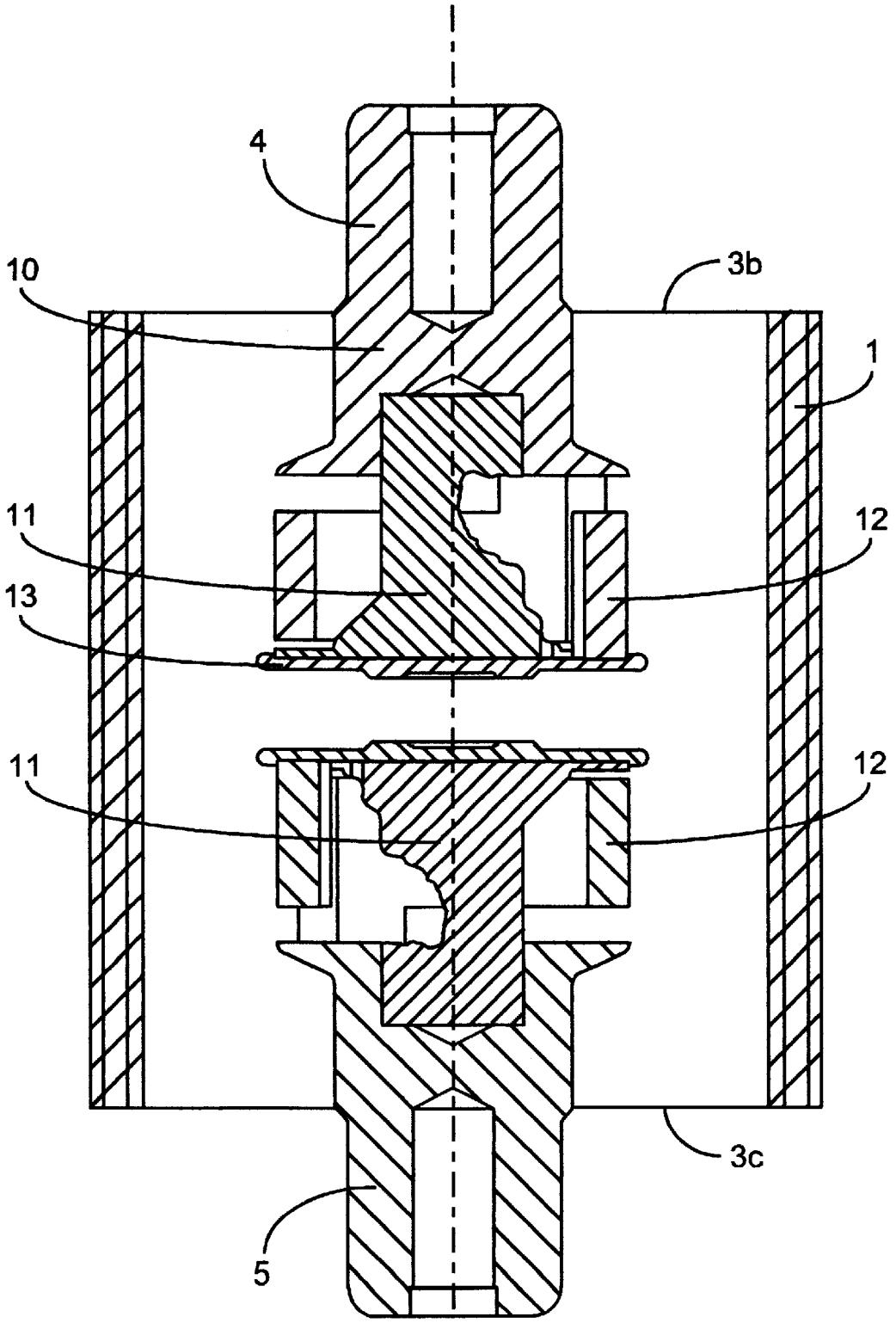
FIG. 4 is an axial sectional view, illustrating a third embodiment of the invention.
Figure 5:
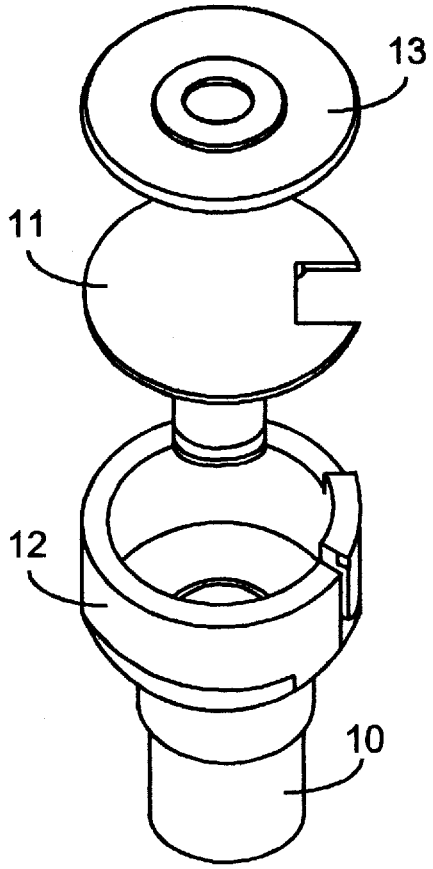
FIG. 5 illustrates, in a perspective view, one of the arcing contacts of the embodiment of FIG. 4.

FIG. 4 illustrates a third embodiment of the invention. In this figure, a vacuum cartridge switch 1 can be seen mainly comprising a cylindrical-shaped insulating enclosure closed by two metallic end-plates 3*b*, 3*c*, and housing two arcing contacts 4, 5 respectively stationary and movable extending coaxially inside said enclosure. The two contacts 4 and 5 have the same structure and are both constituted, as can be seen in FIG. 5, by a conducting rod 10 and a conducting electrode 13 with a coil 12 and branch-off means 11 between the rod and the electrode.

According to the embodiment illustrated in FIG. 4, this branch-off means is a resistive element 11, but fitting a branch-off means formed by a magnetic circuit could also be envisaged.

Thus, all the means performing generation of an axial magnetic field are located inside the vacuum cartridge. These branch-off means by a high resistivity material or a magnetic circuit branch off between 5% and 60% of the current in the coils. This solution is advantageous for permanent currents ranging from 630 A to 3150 A. It moreover enables the mechanical strength of the assembly to be considerably improved when applied in a circuit breaker, and furthermore enables the manufacturing costs to be reduced due to a particularly simple construction of the contacts.

The invention will be advantageously applied to electrical switches belonging to the fields ranging from low voltage up to very high voltage.

The invention is naturally in no way limited to the embodiments described and illustrated which have been given as examples only. On the contrary, the invention comprises all the technical equivalents of the means described as well as the combinations thereof if the latter are achieved according to the spirit of the invention.

We claim:

1. An electrical switch designed to break an electrical circuit, comprising:

an elongated vacuum cartridge with a cylindrical enclosure blanked off by two end-plates, the cartridge housing a stationary arcing contact fixedly secured to one of the end-plates and a movable arcing contact, mounted axially and slidingly inside the cartridge, and at least one coil for producing an axial magnetic field in an arc formation zone, the coil comprising a first end electrically connected to one of the arcing contacts and a second end arranged as a current conducting strip, the first and second ends of the coil being electrically connected, and branch-off means disposed between the first and second ends to branch a part of a main current off through the coil during circuit breaking, thereby producing the axial magnetic field.

2. The switch according to claim 1, wherein the first and second ends of the coil are superposed.

3. The switch according to claim 1, wherein the branch-off means comprises a resistive element.

4. The switch according to claim 1, wherein the branch-off means comprises a magnetic circuit.

5. The switch according to claim 3, wherein the resistive element comprises a resistive washer electrically connecting the first and second ends of the coil.

6. The switch according to claim 4, wherein the magnetic circuit surrounds a conductor electrically connecting the first and second ends of the coil.

7. The switch according to claim 4, wherein the magnetic circuit comprises at least one air-gap designed to delay branching-off of the main current until a predetermined intensity value of the main current has been reached.

8. The switch according to claim 7, wherein branching-off of the main current in the coil occurs above 8000 A.

9. The switch according to claim 1, wherein the coil is formed by a single winding, the winding having two ends both extending with an angular offset, parallel to the end-plates of the cartridge.

10. The switch according to claim 1, wherein the first end of the coil is mechanically secured and electrically connected to the stationary arcing contact.

11. The switch according to claim 1, wherein the branch-off means branches off between 10 and 60% of the main current into the coil.

12. The switch according to claim 1, wherein the coil and branch-off means are disposed outside the vacuum cartridge.

13. The switch according to claim 1, wherein the coil and branch-off means are disposed inside the vacuum cartridge.

14. The switch according to claim 13, wherein the coil and branch-off means are disposed inside one of the arcing contacts between a conducting rod and an electrode of said one of the arcing contacts.

15. The switch according to claim 1, wherein each of the arcing contacts comprises a coil and branch-off means disposed inside the vacuum cartridge.

* * * * *